US006623315B1

(12) United States Patent
Roderick

(10) Patent No.: US 6,623,315 B1
(45) Date of Patent: Sep. 23, 2003

(54) CABLE TERMINAL AND CABLE ASSEMBLY

(75) Inventor: William Roderick, Windsor, CA (US)

(73) Assignee: Gator Loc, LLC, Windsor, CA (US)

( * ) Notice: Subject to any disclaimer, the term of this patent is extended or adjusted under 35 U.S.C. 154(b) by 0 days.

(21) Appl. No.: 10/120,065

(22) Filed: Apr. 9, 2002

(51) Int. Cl.[7] ..... H01R 4/50; H01R 11/00
(52) U.S. Cl. ..... 439/772; 439/504
(58) Field of Search ..... 439/772, 773, 439/770, 769, 761, 756, 504, 762, 759

(56) References Cited

U.S. PATENT DOCUMENTS

| | | | | |
|---|---|---|---|---|
| 1,805,857 A | | 5/1931 | Trimble et al. | |
| 1,920,608 A | | 8/1933 | Thompson | 173/259 |
| 3,047,834 A | | 7/1962 | Ausherman | |
| 3,397,382 A | | 8/1968 | Shannon | |
| 4,060,304 A | * | 11/1977 | Abramson | 439/730 |
| 4,145,075 A | | 3/1979 | Holzmann | 285/81 |
| 4,294,505 A | * | 10/1981 | Gaffney | 439/625 |
| 4,354,726 A | | 10/1982 | Kato et al. | |
| 4,555,159 A | | 11/1985 | Chartrain et al. | |
| 4,664,468 A | | 5/1987 | Woodworth | |
| 4,767,686 A | * | 8/1988 | Frawley | 429/122 |
| 4,934,366 A | * | 6/1990 | Truex et al. | 607/37 |
| 5,088,941 A | | 2/1992 | Nolle | 439/762 |
| 5,350,204 A | | 9/1994 | Henniger | 285/323 |
| 5,564,942 A | | 10/1996 | Lee | 439/462 |
| 5,672,442 A | * | 9/1997 | Burnett | 429/121 |
| 5,707,257 A | * | 1/1998 | Kotajima et al. | 439/762 |
| 5,711,688 A | | 1/1998 | Matsunaga et al. | 439/762 |
| 5,738,552 A | | 4/1998 | Halbach et al. | 439/762 |
| 5,763,823 A | * | 6/1998 | Siekierka et al. | 174/113 R |
| 6,200,173 B1 | * | 3/2001 | Frisby | 439/762 |

* cited by examiner

*Primary Examiner*—Chandrika Prasad
(74) *Attorney, Agent, or Firm*—Scott W. Hewett

(57) ABSTRACT

A cable terminal includes a captivated locking ring and a sealed crimp joint to a cable. In a particular embodiment, the cable terminal is cast from a lead alloy and a crimp tube is lead plated before being cast into the body of the cable terminal. This forms a sealed pocket to accept the stripped end of the cable. The lead plating on the crimp tube cold flows during the crimping operation and forms a secure, reliable mechanical and electrical connection. In a further embodiment, heat shrink tubing with a heat-activated adhesive on the interior of the tubing is formed over the end of the crimp tube and cable.

21 Claims, 3 Drawing Sheets

CABLE TERMINAL AND CABLE ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

The present invention relates generally to cable terminals and cable assemblies such as may be used to connect to a battery post terminal.

Many types of cable terminals have been developed to connect to battery terminals. A common type of battery terminal on a car battery is a post terminal, which is basically shaped as a truncated cone and made of lead alloy. Typical cable terminals for attaching a cable to the battery post have a split, tapered hole that clamps onto the battery post when a clamping bolt is tightened. This can distort the tapered bole, reducing contact area between the cable terminal and the battery terminal, thus increasing series resistance. The clamping bolt is also typically a metal that is galvanically dissimilar from the metal of the cable terminal. This can result in corrosion, particularly in light of the proximity of battery acid and the availability of moisture in the environment.

However, such conventional cable terminals are easy to make and generally allow molding or casting the body of the terminal directly to the stripped end of a cable to make a cable assembly. Unfortunately, the cables are typically copper, while the cast terminal body is typically a lead alloy. This introduces another area of potential galvanic corrosion, particularly if the cable is loosened in the cable body as a result of stress or vibration, allowing moisture to infiltrate to the contact zone between the dissimilar metals.

Casting the cable into the cable terminal body typically results in a cable of fixed length and cable diameter. Repair shops and parts suppliers therefore typically have to carry many different cable assemblies to address the different applications and intended uses. After-market cable terminals are available with a bolt-tightened saddle clamp, but these saddle clamps are typically a galvanically dissimilar metal (galvanized steel) than the lead-based clamp body or cable strands (typically copper). Corrosion and poor electrical contact can result.

A locking ring-type battery connector was developed to avoid the disadvantages associated with the bolt-type cable terminal clamp. This connector uses a single type of metal for two pieces in a cam-type locking arrangement. Such a connector is generally described in U.S. Pat. No. 4,664,468 entitled BATTERY CONNECTOR by Woodworth, issued May 12, 1987. Unfortunately, this connector suffers from a number of problems. First, the rotating locking ring must be aligned with the fixed rings of the battery connector when being connected to the battery post. In other words, the locking ring is a separate part that may be dropped and lost when attaching or removing the battery connector from the battery.

Another problem arises in the attachment of the cable to the battery connector. As with the clamping bolt-type prior art connector, the body of the locking ring-type connector can be molded onto a cable. This can suffer from the same galvanic corrosion and cable loosening described above. The battery connector is also described as being connected to a cable using an expansion screw to force the strands of the cable against an inner surface of a cavity in the battery clamp. As with the clamping bolt, the expansion screw creates a source of galvanic corrosion and also creates another path for electrolyte incursion into the cavity containing the cable end. Even a lead-plated steel screw loses the plating and pinholes, allowing moisture to infiltrate to the cable end and exposing dissimilar metal, which will accelerate galvanic corrosion.

Therefore, a secure, corrosion resistant cable terminal suitable for attaching to post connectors is desirable. It is further desirable that the terminal be easy to manipulate when connecting or disconnecting the cable.

BRIEF SUMMARY OF THE INVENTION

A cable terminal has a cable terminal body with a first ring portion and a second ring portion and a locking ring. The cable terminal body and locking ring are made of galvanically similar materials. In particular embodiments, the cable terminal body and the locking ring are cast from a lead alloy. In other embodiments, the cable terminal and locking ring are cast from other metal(s), such as brass, bronze, or aluminum, or are machined, or made using a combination and variety of methods. The locking ring operates as a cam lock to hold a terminal post against the fixed ring portions. A crimp tube extends from the cable terminal body and is configured to be crimped to a cable end of a preselected size that is stripped of insulation. At least the outer surface of the crimp tube is a metal that is galvanically compatible with the cable terminal body and locking ring material(s). In a particular embodiment, the crimp tube is a lead-plated copper tube that is cast into the cable terminal body, which is made from a castable lead-antimony or lead-calcium alloy, to form a sealed crimp socket. In a further embodiment, the stripped end of the cable is tinned with lead-based solder and the tinned cable strands cold weld to the lead-plated interior of the crimp tube during the crimping process.

In another embodiment, the corrosion-resistant cable terminal is joined to a cable by crimping. Only galvanically similar (compatible) metals are exposed, thus avoiding galvanic corrosion. A piece of heat-shrink tubing with heat-sensitive adhesive (sealant) is formed over the end of the crimp tube where the cable exits, thus sealing the crimp socket and cable end from moisture.

DETAILED DESCRIPTION OF THE INVENTION

A cable terminal for attaching to a post-type connector exposes only galvanically similar metal. In one embodiment, a tube or sleeve is cast into the connector body. The stripped cable end is then crimped or swaged in the tube, providing a secure connection. Thus, battery cables of various lengths may be made up according to the intended application using a few simple tools, which avoids the need to stock multiple lengths of cable assemblies.

The cam-locking cable terminal allows it to be attached to and removed from a battery terminal post without tools. In a particular embodiment, the locking ring is captivated in the cable terminal so that it will not fall out and be lost or damaged when installing or removing the cable terminal from the battery. Embodiments of the present invention may be used in a variety of applications, such as automotive battery cables, but may be particularly desirable in high-reliability applications, such as marine, heavy construction equipment, and military vehicles and equipment, and in maintenance applications, particularly where it might be impractical to stock a comprehensive selection of pre-made cable assemblies.

I. An Exemplary Cable Assembly

Figure 1:
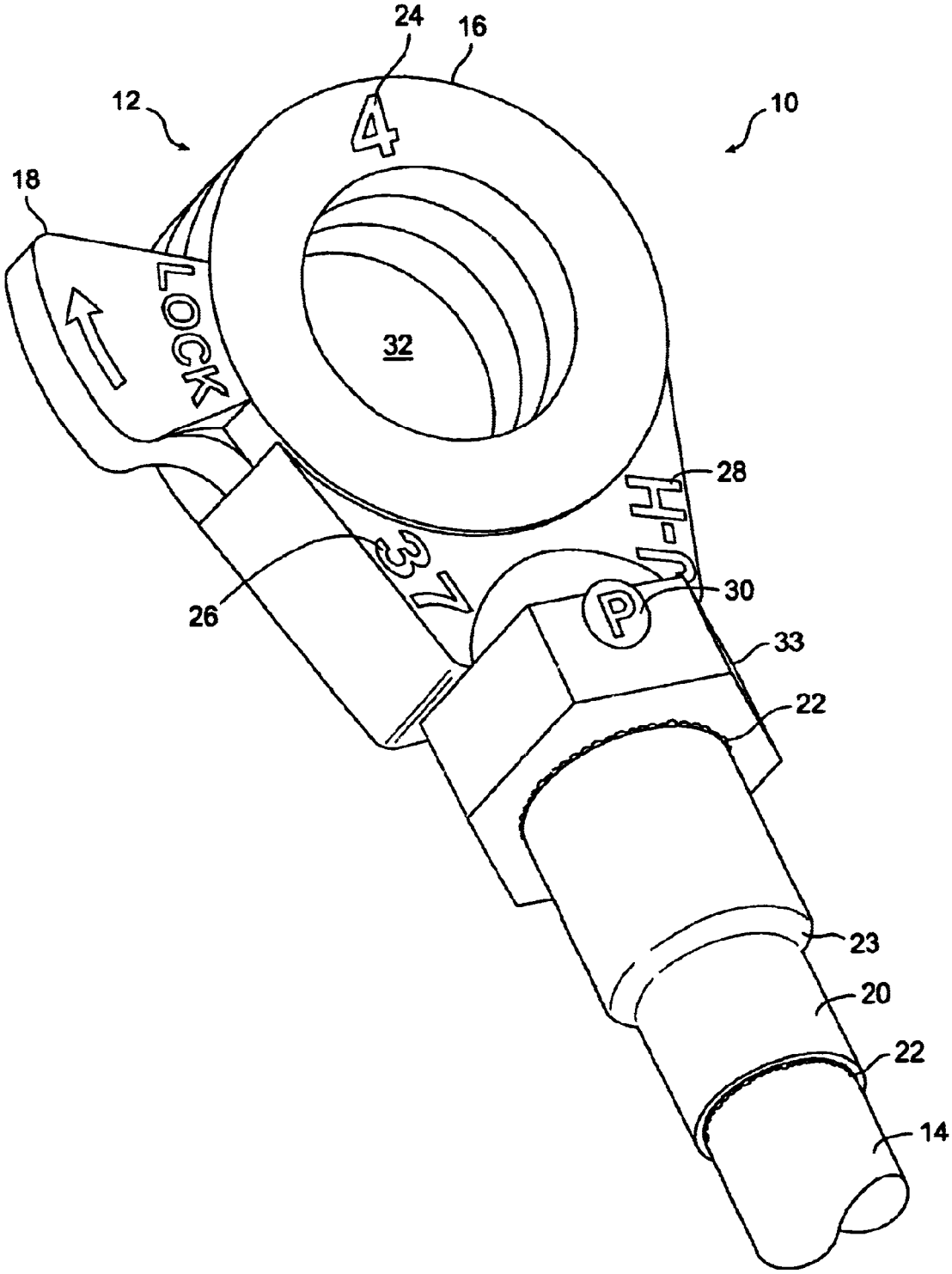
FIG. 1 is a simplified perspective view of a portion of a cable assembly according to an embodiment of the present invention.

FIG. 1 is a simplified perspective view of a cable assembly 10 according to an embodiment of the present invention. The cable assembly includes a cable terminal 12 connected to a cable 14. The cable is typically a multi-strand copper cable, and in a particular embodiment is made from 30 AWG strands of 99.9% pure copper for flexibility and conductivity. While thicker strands can be used, the sealed crimp pocket of this embodiment of the invention protects the fine copper strands from galvanic corrosion. The copper strands are covered with insulation, such as plastic, neoprene, or cross-linked ethylene-propylene-diene-monomer ("EPDM") rubber, which is resistant to fuels, lubricants, and moisture, and thus suitable for automotive-type.applications. In a particular embodiment the insulation is rated at 600 Volts from −50° C. to 105° C. The opposite end of the cable (not shown) is typically terminated with a lug-type connector, of which several types are known in the art.

The cable terminal 12 includes a body portion 16 and a locking ring portion 18. After fitting the cable terminal over a battery post (not shown), the locking ring portion is rotated with respect to the body portion to achieve a "cam lock" connection. This type of connection is discussed further in U.S. Pat. No. 4,664,468. A typical offset between the locking ring opening and body opening is 0.025 inches for a nominally 0.75 inch opening; however, this offset is merely exemplary, and greater of lesser values may be appropriate, depending on the intended use.

The body portion 16 includes several features according to various embodiments of the present invention. The cable 14 is crimped in a metal tube (see FIG. 2A, ref. num. 34) and then sealed with heat-shrink tubing 20 that includes heat-activated adhesive 22. The heat-shrink tubing extends beyond the end 23 of the crimp tube, which provides a moisture-proof seal not only at the ends of the heat-shrink tubing, but also laterally along the crimp tube and the covered portion of the cable insulation. The shrink tubing in combination with the heat-activated adhesive forms a seal between the insulation of the cable and the crimp tube. In some embodiments, the crimp tube is plated with a metal that is galvanically similar to the metal of the body and locking ring, thus no dissimilar metals are exposed on the cable terminal to cause galvanic corrosion.

The appropriate cable size 24 is cast into the body, as are die settings 26, 28 that indicate the appropriate crimper or die to use with this particular connector and cable. Several cable sizes are possible, such as 6 gauge, 4 gauge, 2/1 gauge, 0 gauge, and 00gauge, for example, for a suitably sized cable terminal. A reliable, corrosion resistant replacement cable assembly could thus be made from a stock roll of cable and suitable cable terminal end without needing to stock a wide assortment of pre-made cable assemblies in various lengths. The opposite end of the cable terminal typically has a lug type (bolt-on) connector, which can be soldered or crimped, for example. The lug is a closed-end lug and a piece of shrink tubing is applied over the end of the lug and cable to seal the junction.

The first die setting 26 indicates the proper crimper of one selected manufacturer, and the second die setting 28 indicates the proper crimper of another selected manufacturer. For example, the first die setting could be for a crimping tool made by THOMAS AND BETTS while the second die setting is for a tool made by AMP™. The polarity indicator 30 may also be cast into the body. Some batteries may have different posts for the positive and negative polarity, so the cable terminals may have different bores for the opposite polarities. It is understood that the term "crimping" is used herein for purposes of convenient discussion, and is intended to include the process commonly known as swaging and similar processes.

A circular opening 32 accepts the post terminal. Battery posts are typically tapered at an angle of about 2.5–3 degrees, and the final taper is machined in the cast cable terminal body and locking ring for a precise fit. In other applications, such as attaching cables to plating ingots or fuel cells, the posts might not be tapered and the center opening might be cylindrical. The circular opening in the locking ring is concentric with the circular openings in the body when the locking ring is in a first position. In a second position, achieved by rotating the locking ring with respect to the body, the circular opening in the locking ring is eccentric with respect to the circular openings in the body.

Optionally, a hexagonal "nut" 33 is cast as part of the terminal body, usually in a standard SAE or metric size. This nut facilitates holding the terminal body in a vise or with a wrench or other tool while the crimp tube is crimped to the cable end, without unduly distorting the cable terminal body. In an alternative embodiment, the crimp tube is replaced with a threaded cable insert tube of approximately the same configuration, namely with a "blind" pocket. A compression nut can then be placed over the stripped cable end and screwed into the threaded cable insert tube to secure the cable to the cable terminal. It is desirable that only galvanically compatible materials are exposed on the cable terminal after tightening the compression nut. Shrink tubing can then be formed over the insert tube and compression nut. In this embodiment, the nut cast into the terminal body facilitates tightening the compression nut.

II. An Exemplary Cable Terminal

Figure 2A:
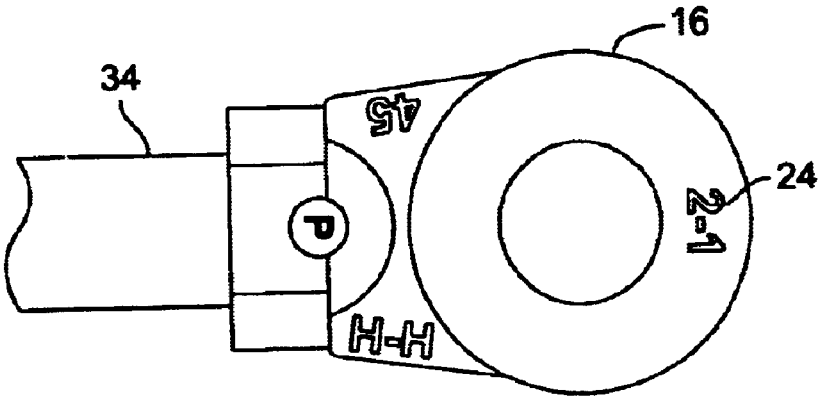
FIG. 2A is a simplified top view of a cable terminal body according to an embodiment of the present invention.

FIG. 2A is a simplified top view of a cable terminal body portion 16 according to an embodiment of the present invention. The crimp tube 34 is cast into the body of the cable terminal. In one embodiment, the crimp tube is a lead plated copper tube and the body is a castable lead alloy, such as an antimony-lead (e.g. 9% antimony 81% lead) alloy or a calcium-lead alloy (e.g. about 0.01–17% calcium with essentially the remainder lead). This provides a cable terminal with galvanically similar metal, i.e. lead or lead alloy, exposed on its surface, thus avoiding galvanic corrosion. Other metals can be included in suitable alloys, such as tin, particularly in the lower ranges of calcium. A number of suitable castable calcium-lead alloys are provided in *Properties of Lead and Lead Alloys*, available from Lead Industries Association, Inc., 292 Madison Avenue, New York, N.Y. 10017. Generally speaking, harder lead alloys are more easy to machine, if necessary.

Corrosion potential for pure metals is typically shown in an electromotive force ("emf") series for a metal and its ions in equilibrium under standard conditions. In the case of battery clamps and terminal posts, the metals are typically alloys (not pure metal) and equilibrium under standard conditions rarely occurs. The propensity for galvanic corrosion arising from galvanic mismatch of metal alloys is typically indicated by a galvanic series, without an absolute (i.e. calibrated) numerical value for the galvanic potential.

Galvanic corrosion arises because at least two corroding metals are electrically connected in the presence of an electrolyte, such as battery fumes and environmental moisture. Therefore, it is understood that non-galvanic corrosion typically occurs on the battery cable terminal. Fortunately, the oxide coating that often forms on lead-based connectors is relatively benign and is reasonably electrically conductive. Galvanic corrosion, if it occurs, typically accelerates the corrosion of the more galvanically active (anodic) part relative to the less galvanically active (cathodic) part.

In general, the position of metals or alloys on a galvanic series agrees with the placement of their constituent elements in the emf series; however, passivation can influence galvanic behavior, as can environmental conditions, such as temperature and electrolyte. Typically, alloys that are similar in composition, such as copper, copper bronzes, and brasses; or lead and lead-based alloys (such as antimony-lead and calcium-lead), may be used in most practical applications with little danger of galvanic corrosion. Metals that are further apart in the series raise a greater potential for galvanic corrosion. It is desirable that a cable terminal for use in an intended environment have galvanically similar metals, that is, metals that are closer on a galvanic series for the intended application environment than antimony-lead (9%–81%) and plain steel.

Similarly, while the cable terminal itself exposes only galvanically similar metals, it is understood that the appropriate cable terminal is selected in light of the intended terminal post that it is to be connected to. In other words, a cable terminal made from lead-based alloys should be connected to a lead-based battery terminal, and a brass or bronze cable terminal should be connected to a brass or bronze battery terminal. Accordingly, it would generally be undesirable to connect a lead-based cable terminal to a bronze battery terminal, or vice versa.

Calcium-lead alloys are typically harder than corresponding antimony-lead alloys, but melt at a higher temperature and thus the casting process is slower because additional heat must be removed from the mold for each part that is produced, typically increasing cycle time. A harder alloy can be used in a cam-lock type connector than would be desirable in a conventional clamping-bolt type connector because the cam-lock connector does not distort when being attached to the battery post, as do connectors with squeeze bolts. The harder alloy, in turn, preserves the dimensions of the center bore, and provides a secure, high contact area connection to the battery post. The calcium-lead alloy is also more resistant to ordinary corrosion than antimony-lead alloy.

When the crimp tube 34 is lead plated on the inside, and the tinned cable end can be crimped inside the tube. The solder (tinning) cold flows with the lead plating inside the crimp tube to form an excellent electrical connection. The deformation of the copper tube around the cable strands also provides an excellent structural connection.

In yet another embodiment, the cable end is not tinned, and in a yet further embodiment, the inside of the crimp tube is not plated. The heat-shrink tubing provides a seal against moisture, thus avoiding galvanic corrosion by forming a barrier against electrolyte intrusion into the crimp pocket. In alternative embodiments, the crimp tube is cast with the connector body from a metal alloy that is sufficiently strong to form a secure mechanical connection to the cable end after crimping, and sufficiently ductile to be crimped without cracking.

Figure 2B:
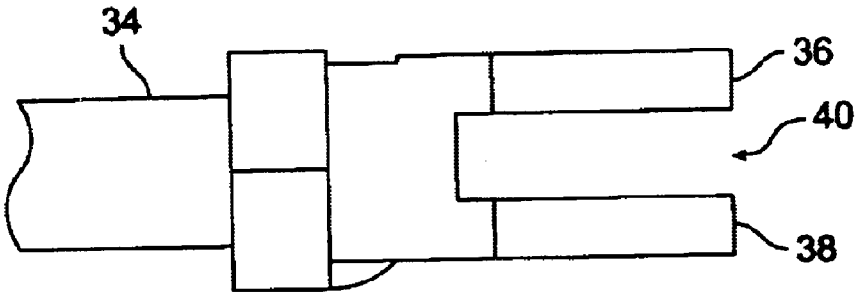
FIG. 2B is a simplified side view of the cable terminal body shown in FIG. 2A.

FIG. 2B is a simplified side view of the cable terminal body shown in FIG. 2A. A pair of bifurcated ring portions 36, 38 form a gap for receiving the locking ring. The holes through the upper 36 and lower 38 ring portions are substantially co-axial, and are generally tapered to accept a battery terminal post, but may be cylindrical in other applications.

Figure 2C:
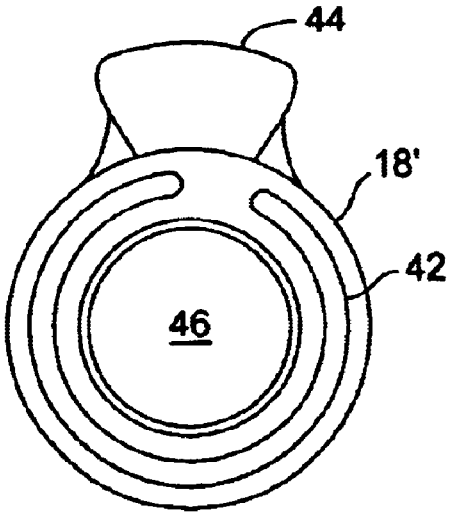
FIG. 2C is a simplified bottom view of a locking ring according to an embodiment of the present invention.

FIG. 2C is a simplified bottom view of a locking ring 18' according to an embodiment of the present invention. The locking ring is cast from the same alloy as the cable terminal body shown in FIGS. 2A and 2B, but this is not required. A corrosion-resistant cable clamp can be made if the locking ring is made of a galvanically similar metal as the body. Alternatively, the locking ring can be made of a non-metallic material, but this reduces the possible electrical contact area between the cable terminal and the battery post. Alternatively, the body and or locking ring can be machined out of a metal, rather than cast.

The locking ring 18' includes a channel or groove 42 formed in the bottom face of the ring and a tab 44 that provides a convenient feature for tightening and loosening the cable terminal. A blind hole is cast or drilled into the body of the cable terminal, and, after assembling the locking ring into the gap between the bifurcated ring portions, a punch is used to deform the bottom of the blind hole into the groove in the locking ring. This captivates the ring in the assembly while allowing the ring to rotate with respect to the bifurcated ring portions. The groove is illustrated as being partially circumferential, but could be fully circumferential. In another embodiment, a galvanically compatible pin could be partially inserted into the groove. A galvanically compatible pin could be made from a galvanically similar metal or a non-conductor, for example.

The opening 46 is on one side of the cable terminal along the centerline of the crimp tube. This allows much greater cam surface to be utilized when tightening the terminal. In one embodiment, the eccentricity is fully "open" when the tab is rotated to be stopped against the connector body (either fully clockwise or fully counterclockwise, depending on a design choice, as viewed from above). Rotating the tab away from the stopped position "closes" the eccentricity, thus tightening the battery post in the cable connector opening. Prior devices were fully open when the tab was in the center of the connector body, tightening when the tab was rotated in either direction from the center position.

Unfortunately, there is typically some degree of run-out before the locking ring engages the battery terminal post. This can arise due to manufacturing tolerances of the clamp and/or battery terminal post. Similarly, the post and/or clamp can become distorted (worm) during use, particularly with repeated tightening, especially if relatively soft materials, such as antimony-lead, are used. Prior designs were restricted to less than 180 degrees (typically about 130 degrees) of rotation to either side from a center position.

Embodiments of the present invention where the open position begins at full rotation in one direction or the other enjoy essentially twice the rotational arc for tightening the clamp on a post. Additionally, whereas a center-open design exhibits run-out to either side of the center position, beginning the tightening arc at one end of the range eliminates half this run-out. In other words, not only is a greater arc available for tightening, less of the tightening arc is used to take up run-out.

Figure 3A:
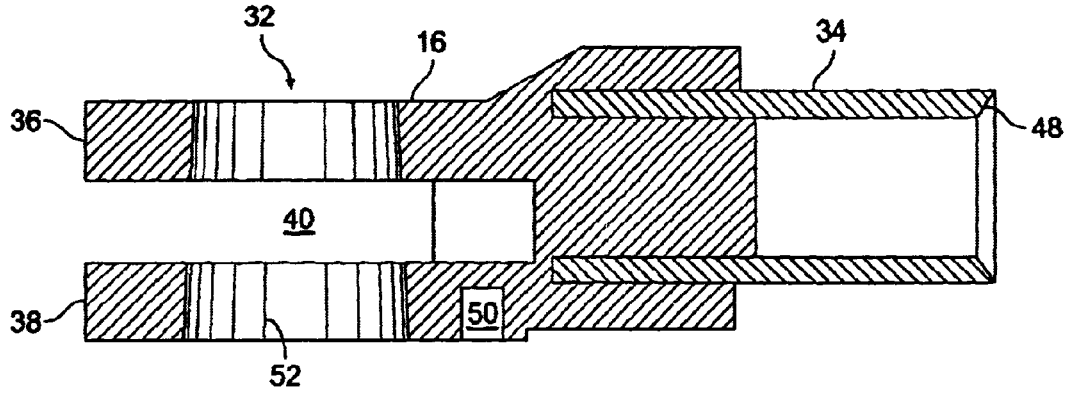
FIG. 3A is a simplified cross section of a cable terminal body according to an embodiment of the present invention.

FIG. 3A is a simplified cross section of a cable terminal body 16 according to an embodiment of the present invention. The crimp tube 34 is cast into the body and includes a chamfer 48 to assist in the insertion of the cable into the crimp tube. A blind hole 50 is cast into the bottom of the cable terminal body. The interior surface of the circular opening 32 is splined 52, which helps in the cold weld process of attaching the lead connector to a lead battery post. Similar splines are cut into the center opening of the locking ring, if desired. The splines are about 1–5 mils deep and are typically cut into the sides of the center opening.

The crimp tube is cast in the cable terminal body to form a socket for the cable end. The socket is sealed at the terminal end and another sealant can be applied at the chamfered end of the crimp tube, typically extending over a portion of the cable insulation, after inserting the cable end and crimping the terminal on. The interior of the crimp tube is thus moisture-resistant and preferably anaerobic to avoid corrosion of fine-gauge wires and possibly degrade the electrical contact between the cable terminal and the cable. In a particular embodiment, portion of the crimp tube extending out of the cable terminal body provides a gauge for stripping the insulation from the end of an associated cable to be inserted into the crimp tube. Thus this feature provides a degree of self-documentation, along with the wire size indicator (FIG. 1, ref. num. 24) and crimp tool indicator (s) (FIG. 1, ref. nums. 26, 28).

Figure 3B:
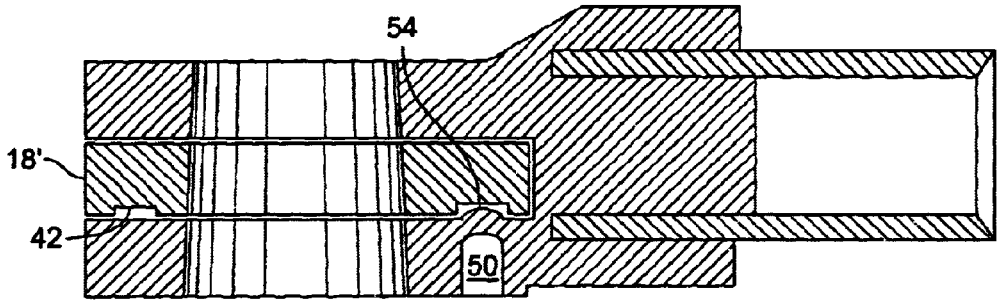
FIG. 3B is a simplified cross section of a cable terminal body and captive locking ring according to another embodiment of the present invention.

FIG. 3B is a simplified cross section of a cable terminal body 16 and captive locking ring 18' according to another embodiment of the present invention. The bottom of the blind hole 50 has been punched to form a dimple 54 that extends into the groove 42 in the locking ring 18'. The location of the bind hole is only illustrative, and could be moved to another location on the bottom of the body of the cable terminal, or to the top of the body of the cable terminal if the groove in the locking ring is on its topside. The dimple captivates the locking ring while allowing it to move without introducing or exposing any galvanically dissimilar metals.

In alternative embodiments the cable terminal might be formed of other metals. For example, in a plating application the cable terminal body, locking ring, and perhaps even the cable could be made of metal compatible with the plating process, such as an all-aluminum or all-copper cable assembly. In such an application the crimp tube might not be cast into the cable terminal body, but might be machined. In such an application it may be acceptable to omit the shrink tubing seal between crimp tube and cable.

III. Exemplary Methods of Fabricating a Cable Assembly

Figure 4:
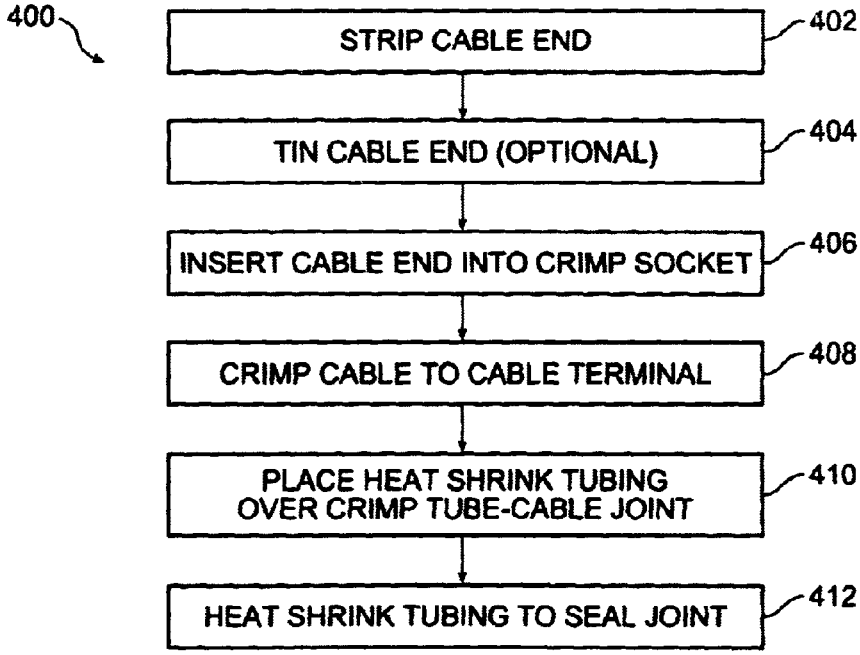
FIG. 4 is a simplified flow chart of a method of fabricating a cable assembly according to an embodiment of the present invention.

FIG. 4 is a simplified flow chart of a method 400 of fabricating a cable assembly according to an embodiment of the present invention. The cable assembly may be made-up ahead of time for a particular application, or may be made up as needed from components. The latter approach is particularly desirable in repair-type situations where stocking a comprehensive selection of pre-made cable assemblies (e.g. cable assemblies with the cables cast into the cable terminal) may be impractical. Hundreds of different cable lengths might be necessary to cover just one common cable gauge, and several cable gauges are used in various applications. Similarly, a replacement cable might not be in stock, and having to special order the part might keep a valuable piece of equipment out of operation.

The insulation is stripped to form a bare cable end (step 402). The amount of insulation removed is generally selected according to the depth of a crimp socket on an associated cable terminal. The cable end is optionally tinned in lead-based solder (step 404) before being inserted into the crimp socket (step 406) and crimped (step 408) to attach the cable terminal. Heat shrink tubing with a heat-sensitive adhesive or sealant on the interior of the heat shrink tubing is placed over the other end of the cable (step 410) and formed (heat shrunk) over the joint between the cable and the crimp end (step 412) to seal the crimp socket.

The cable terminal does not have any galvanically dissimilar metals exposed, thereby avoiding galvanic corrosion. A locking ring rotates relative to the crimp terminal body to press the post terminal against fixed rings in the terminal.

While the invention above has been described with respect to specific embodiments, substitutions, modifications, and equivalents may become apparent to those skilled in the art. For example, a cable terminal might be made out of aluminum with an aluminum cable crimped into an aluminum crimp tube. Similarly, many other examples of galvanically compatible materials exist. Accordingly, the embodiments described above are merely exemplary and not limiting of the invention, which is defined by the following claims.

What is claimed is:

1. A cable terminal comprising:

a cable terminal body made of a cable terminal body material and having a first ring portion and a second ring portion;

a locking ring made of a locking ring material that is galvanically compatible with the cable terminal body material and that is rotatably disposed between the first ring portion and the second ring portion to accept a terminal post through the first ring portion, the locking ring, and the second ring portion when the locking ring is in a first position with respect to the cable terminal body, and tightening the terminal post against at least one of the first ring portion and the second ring portion when the locking ring is rotated to a second position with respect to the cable terminal body; and a crimp tube extending from the cable terminal body and being configured to be crimped to a cable end of a preselected size to provide a sealed crimp pocket, at least an outer surface of the crimp tube being a metal that is galvanically compatible with the cable terminal body material so that the cable terminal has only galvanically similar metal surfaces exposed.

2. The cable terminal of claim 1 further comprising:

a groove formed in a face of the locking ring, and a dimple formed from the cable terminal body material without removal of cable terminal body material and within the groove to allow the locking ring to rotate between the first position and the second position, and to retain the locking ring between the first ring portion and the second ring portion of the cable terminal body when the cable terminal is removed from the terminal post.

3. The cable terminal of claim 1 wherein the cable terminal body is cast of a first metal comprising a lead alloy and the crimp tube comprises a tube of a second metal coated with metal selected from the group consisting of lead, the lead alloy, and a second lead alloy to provide a secure crimp connection to the cable end and a crimp tube surface that is galvanically compatible with the first metal.

4. The cable terminal of claim 1 wherein the cable terminal body is cast of a lead alloy, the locking ring is cast of the lead alloy, and the crimp tube is a lead-plated copper tube cast into the cable terminal body to provide a secure crimp connection to the cable end and a crimp tube surface that is galvanically compatible with the lead alloy.

5. The cable terminal of claim 1 wherein the cable terminal body material is selected from a group consisting of copper, copper-based bronze, and brass.

6. The cable terminal of claim 5 wherein the crimp tube is formed from the cable terminal body material.

7. The cable terminal of claim 1 wherein the cable terminal body material is selected from a group consisting of aluminum and aluminum alloy.

8. The cable terminal of claim 7 wherein the crimp tube is formed from the cable terminal body material.

9. The cable terminal of claim 1 wherein the locking ring material is a non-conductive material.

10. The cable terminal of claim 1 further comprising a wire size indicator and a crimp tool indicator on the cable terminal body.

11. A cable terminal comprising:

a cable terminal body made of a lead alloy and having a first ring portion and a second ring portion;

a captivated locking ring made of the lead alloy and that is rotatably disposed between the first ring portion and the second ring portion to accept a terminal post through the first ring portion, the captivated locking ring, and the second ring portion when the locking ring is in a first position with respect to the cable terminal body, and tightening the terminal post against at least one of the first ring portion and the second ring portion when the captivated locking ring is rotated to a second position with respect to the cable terminal body, the captivated locking ring being retained between the first ring portion and the second ring portion when the cable terminal is removed from the terminal post; and a lead-plated copper crimp tube cast into the cable terminal body forming a sealed crimp pocket and providing a secure crimp connection to the cable end and a crimp tube surface that is galvanically compatible with the lead alloy.

12. A cable assembly comprising:

a cable terminal body cast of a lead alloy and having a first ring portion and a second ring portion;

a captivated locking ring made of the lead alloy, the captivated locking ring being disposed between the first ring portion and the second ring portion to accept a terminal post through the first ring portion, the captivated locking ring, and the second ring portion when the captivated locking ring is in a first position with respect to the cable terminal body, and tightening the terminal post against at least one of the first ring portion and the second ring portion when the captivated locking ring is rotated to a second position with respect to the cable terminal body, the captivated locking ring being retained between the first ring portion and the second ring portion when the cable terminal is removed from the terminal post;

a lead-plated copper crimp tube forming a sealed crimp pocket having a first end cast into the cable terminal body and a second end distal from the cable terminal body, the lead-plated copper crimp tube being crimped to an end of a cable, the cable having an outer insulative covering wherein a portion of the outer insulative covering is removed to expose the end of the cable; and a section of heat shrink tubing extending over at least a portion of the lead-plated copper crimp tube, the second end of the lead-plated copper crimp tube, and an insulated portion of the cable extending from the second end of the lead-plated copper crimp tube.

13. The cable assembly of claim 12 wherein the cable comprises copper strands and the end of the cable is tinned to form tinned copper strands, the tinned copper strands being cold welded to the lead-plated copper crimp tube when crimped.

14. The cable assembly of claim 12 wherein the end of the cable is cast into the lead-plated copper tube.

15. The cable assembly of claim 12 wherein the cable comprises copper strands not larger than 30 AWG.

16. The cable assembly of claim 12 further comprising heat-sensitive adhesive disposed between the section of heat-shrink tubing and at least the second end of the lead-plated copper crimp tube.

17. A cable assembly comprising:

a cable terminal body cast of a lead alloy and having a first ring portion and a second ring portion;

a captivated locking ring made of the lead alloy, the captivated locking ring being disposed between the first ring portion and the second ring portion to accept a terminal post through the first ring portion, the captivated locking ring, and the second ring portion when the captivated locking ring is in a first position with respect to the cable terminal body, and tightening the terminal post against at least one of the first ring portion and the second ring portion when the captivated locking ring is rotated to a second position with respect to the cable terminal body, the captivated locking ring being retained between the first ring portion and the second ring portion when the cable terminal is removed from the terminal post; and an end of a cable cast into the cable terminal body.

18. The cable assembly of claim 17 wherein the first ring portion has a first interior surface, the second ring portion has a second interior surface, and the captivated locking ring has a third interior surface, and at least one of the first interior surface, the second interior surface, and the third interior surface includes splines to facilitate a cold weld between the cable assembly and a battery terminal post.

19. The cable assembly of claim 17 wherein the captivated locking ring includes a groove formed in a face of the captivated locking ring, and wherein the cable terminal body includes a dimple within the groove.

20. The cable assembly of claim 17 wherein the captivated locking ring includes a tab proximate to the cable terminal body in the first position.

21. A cable terminal comprising:

a cable terminal body made of a lead alloy and having a first ring portion and a second ring portion;

a captivated locking ring made of the lead alloy having a groove formed in a face of the locking ring, and a dimple formed from the lead alloy of the cable terminal body without removing any of the lead alloy and within the groove to allow the locking ring to rotate between the first position and the second position, and to retain the locking ring between the first ring portion and the second ring portion of the cable terminal body; and means for attaching a cable to the cable terminal.

* * * * *